US009466909B1

(12) United States Patent
Lin et al.

(10) Patent No.: US 9,466,909 B1
(45) Date of Patent: Oct. 11, 2016

(54) CONNECTOR

(71) Applicant: HTC Corporation, Taoyuan (TW)

(72) Inventors: Sheng-Chieh Lin, Taoyuan (TW); Chun-Wei Chang, Taoyuan (TW); Wen-Hsiung Shih, Taoyuan (TW); Chih-Ting Chen, Taoyuan (TW); Sung-Chi Tsai, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 14/878,690

(22) Filed: Oct. 8, 2015

(51) Int. Cl.
*H01R 13/71* (2006.01)
*H01H 13/52* (2006.01)
*H01R 13/24* (2006.01)

(52) U.S. Cl.
CPC ..... *H01R 13/2464* (2013.01); *H01R 13/2421* (2013.01)

(58) Field of Classification Search
CPC ..... H01R 13/71; H01R 13/2421; H01R 2103/00; H01R 13/7032; H01R 13/70; H01R 13/2428; H01H 13/52; H01H 13/50; H01H 13/12; H01H 1/54; H01H 1/20; H01H 13/14; H01H 13/705
USPC ..... 439/188, 700; 200/534, 250, 341, 521, 200/520
See application file for complete search history.

(56) References Cited

U.S. PATENT DOCUMENTS 3,678,442 A * 7/1972 Cope ..... B61G 5/10 439/187
3,711,667 A * 1/1973 Farrell ..... H01H 13/02 200/243
4,136,569 A * 1/1979 Hollweck ..... H01H 5/045 124/10
4,658,212 A * 4/1987 Ozawa ..... G01R 31/045 324/72.5
5,055,643 A * 10/1991 Pardini ..... H01H 3/022 200/302.2
5,063,276 A * 11/1991 Woodard ..... H01H 1/18 200/241
5,112,237 A * 5/1992 Yang ..... H01R 13/20 200/317
5,380,970 A * 1/1995 Mizuno ..... H01H 13/562 200/517
6,717,077 B1 * 4/2004 Chevarie ..... H01R 13/44 200/51.09
7,059,880 B2 * 6/2006 McMaster ..... H01R 9/05 439/188
2005/0009391 A1 * 1/2005 Jordan ..... H01R 13/7033 439/188
2015/0280370 A1 * 10/2015 Huang ..... H01R 24/46 439/188

* cited by examiner

*Primary Examiner* — Gary Paumen
(74) *Attorney, Agent, or Firm* — Birch, Stewart, Kolasch & Birch, LLP

(57) ABSTRACT

A connector is provided, including a housing, a conductive contact disposed in the housing, a hollow structure disposed in the housing, and an electrical connecting mechanism. The electrical connecting mechanism is movably disposed in the hollow structure, including a first conductive member, a first spring, a second conductive member, and a second spring. The first spring connects the first conductive member with the hollow structure and provides a first spring force such that the first conductive member protrudes from the hollow structure. The second conductive member and the second spring are movably disposed in the first conductive member, wherein the second spring connects to the first and second conductive members and provides a second spring force such that the second conductive member protrudes from the first conductive member. Specifically, the second conductive member and the conductive contact are spaced apart by a distance. When the first conductive member is pushed by an external force and slides to a predetermined position in a first direction with respect to the hollow structure, the first spring is compressed, and the second conductive member moves in the first direction and contacts the conductive contact.

10 Claims, 7 Drawing Sheets

CONNECTOR

BACKGROUND OF THE INVENTION

1. Field of the Invention

The application relates in general to a connector, and in particular, to a pogo pin connector.

2. Description of the Related Art

General power chargers for portable or wearable electronic devices usually have a pogo pin connector, as shown in FIGS. 1A and 1B, so that the electronic devices can be electrically connected to and charged by the power chargers. Referring to FIG. 1A, a conventional pogo pin connector primarily comprises a housing H, a plurality of pogo pins P, springs S, and hollow conductive structures C1~C4. The conductive structures C1~C4 are disposed in the housing H, and the springs S are respectively disposed in the conductive structures C1~C4. The pogo pins P respectively contact the springs S and electrically connect to the conductive structures C1~C4 in a slidable manner.

As shown in FIG. 1B, the leftmost and rightmost conductive structures C1 and C4 are respectively connected to a ground signal and a power signal (5V). When the four pogo pins P simultaneously contact a metal conductor M, such as a housing of a mobile phone or a metal housing of a pen, a short circuit between the conductive structures C1 and C4 may occur and cause a serious spark, thus reducing the safety of usage.

BRIEF SUMMARY OF INVENTION

To address the deficiency of conventional connectors, the invention provides a connector including a housing, a conductive contact disposed in the housing, a hollow structure disposed in the housing, and an electrical connecting mechanism. The electrical connecting mechanism is movably disposed in the hollow structure, including a first conductive member, a first spring, a second conductive member, and a second spring. The first spring connects the first conductive member with the hollow structure and provides a first spring force such that the first conductive member protrudes from the hollow structure. The second conductive member and the second spring are movably disposed in the first conductive member, wherein the second spring connects to the first and second conductive members and provides a second spring force such that the second conductive member protrudes from the first conductive member. Specifically, the second conductive member and the conductive contact are spaced apart by a distance. When the first conductive member is pushed by an external force and slides to a predetermined position in a first direction with respect to the hollow structure, the first spring is compressed, and the second conductive member moves in the first direction and contacts the conductive contact.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The making and using of the embodiments of the connectors are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood to one of ordinary skill in the art to which this invention belongs. It should be appreciated that each term, which is defined in a commonly used dictionary, should be interpreted as having a meaning conforming to the relative skills and the background or the context of the present disclosure, and should not be interpreted by an idealized or overly formal manner unless defined otherwise.

Figure 1A:
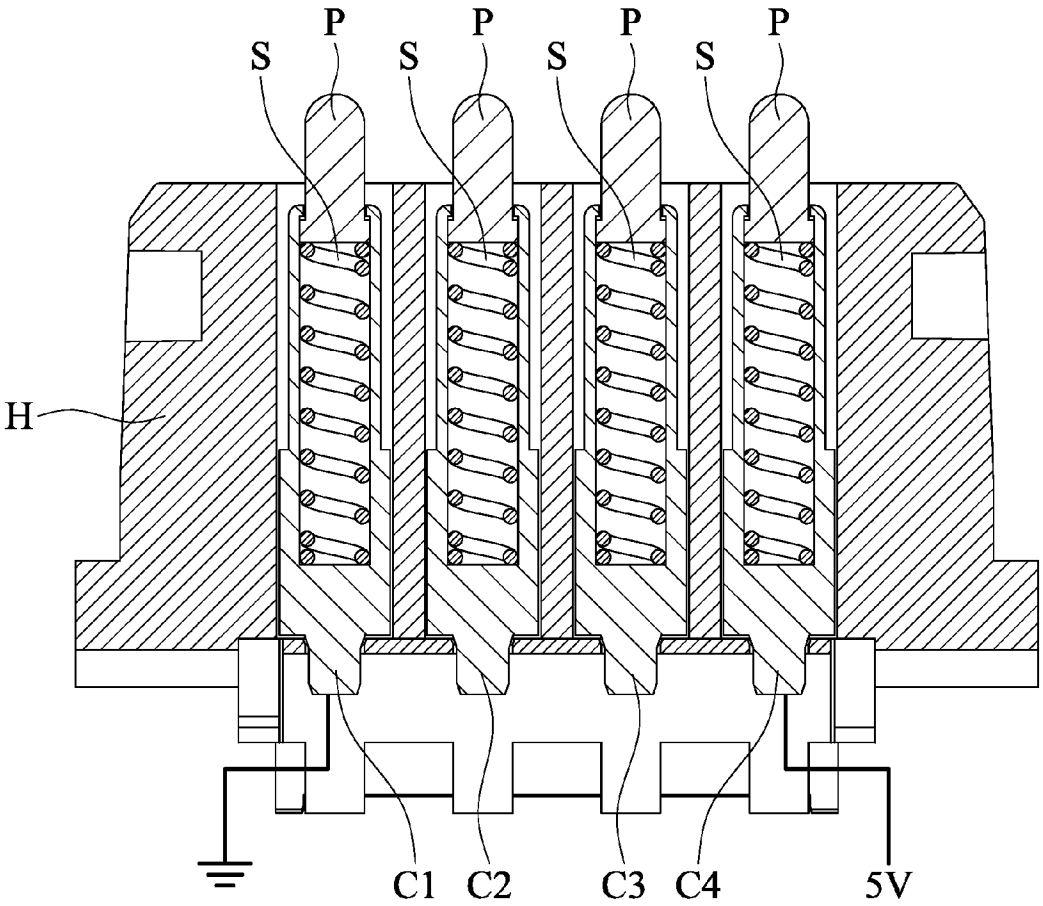
FIG. 1A is a schematic diagram of a conventional pogo pin connector.
Figure 1B:
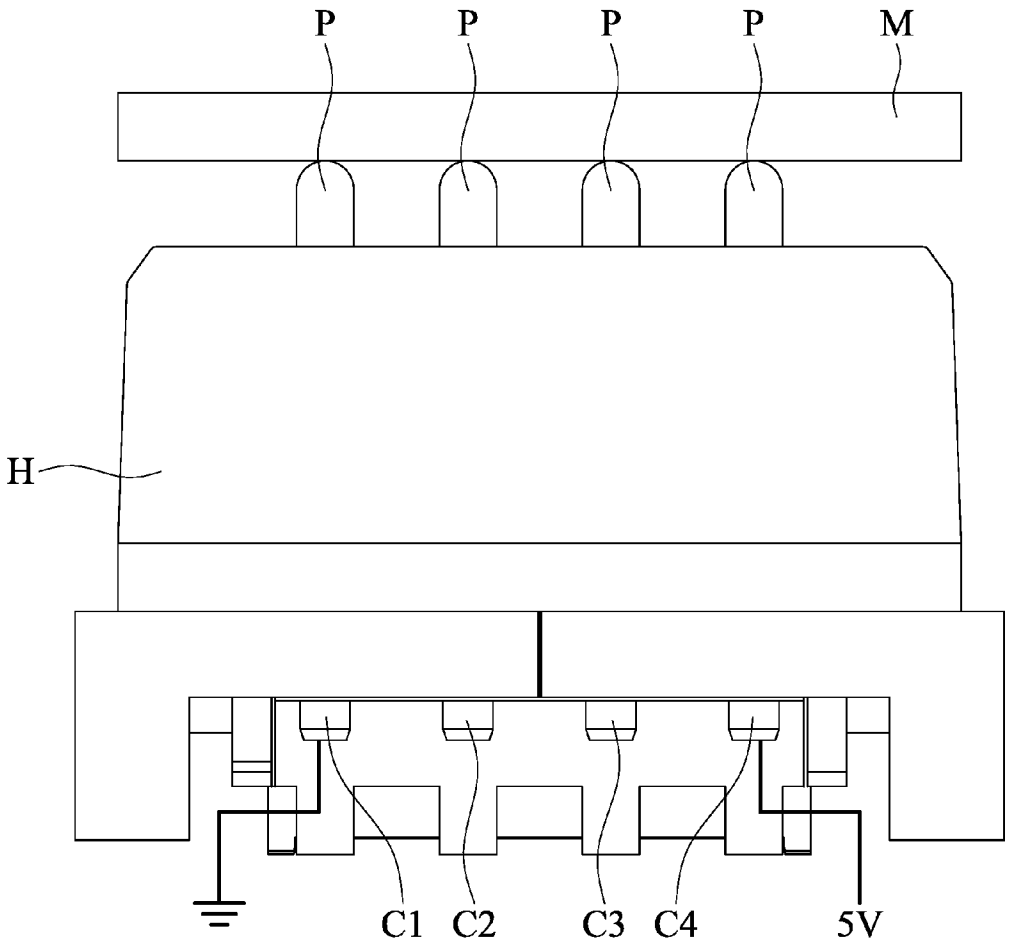
FIG. 1B is a schematic diagram of the pogo pins P in FIG. 1 when in contact with a metal conductor M.
Figure 2A:
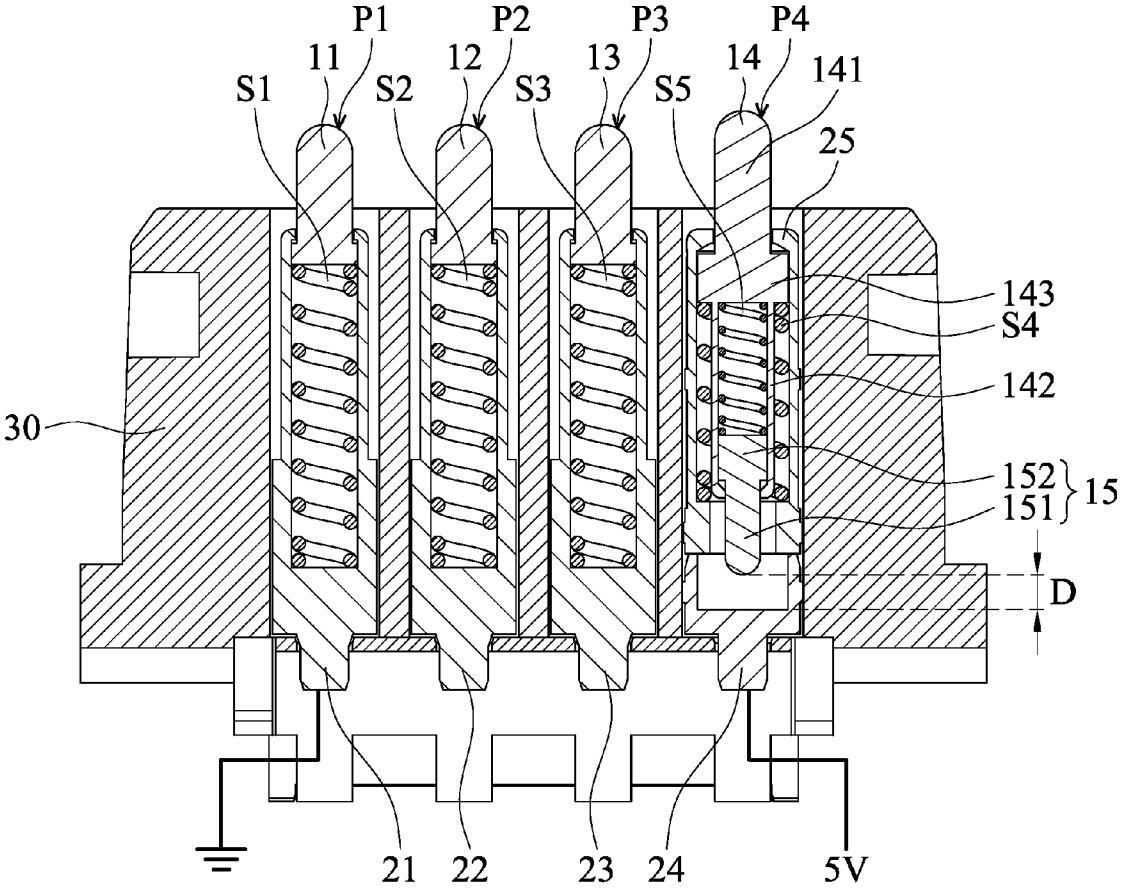
FIG. 2A is a cross-section view of a connector according to an embodiment of the invention.

Referring to FIG. 2A, a connector according to an embodiment of the invention is a pogo pin connector, comprising a housing 30 with three pogo pin units P1~P3 and an electrical connecting mechanism P4 received therein. The pogo pin units P1~P3 includes three pogo pins 11~13, three hollow conductive structures 21~23, and three springs S1~S3 respectively received in the conductive structures 21~23. The pogo pins 11~13 respectively contact the springs S1~S3 and electrically connect to the conductive structures 21~23 in a slidable manner. As shown in FIG. 2A, a hollow member 25 is disposed in the housing 25 with the electrical connecting mechanism P4 movably received therein. Additionally, a conductive contact 24 is disposed below the hollow member 25, and the electrical connecting mechanism P4 is not in contact with the conductive contact 24 before an external force is exerted thereon.

Figure 2B:
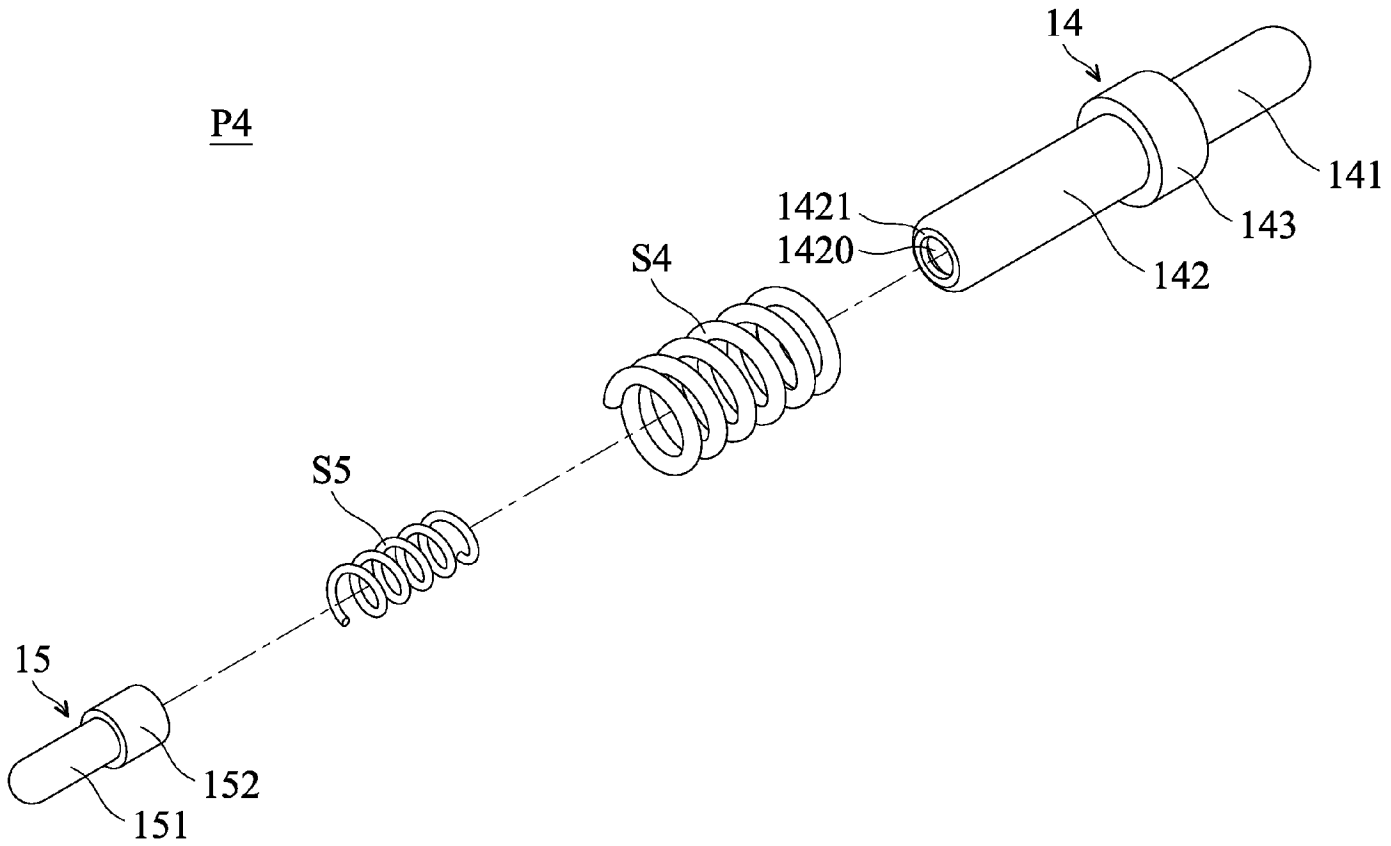
FIG. 2B is an exploded diagram of the electrical connecting mechanism P4 in FIG. 2A.

Referring to FIGS. 2A and 2B, the electrical connecting mechanism P4 according to this embodiment primarily comprises a first conductive member 14, a first spring S4, a second conductive member 15, and a second spring S5. In FIG. 2A, the first spring S4 is in contact between the inner surfaces of the first conductive member 14 and the hollow member 25, such that the first conductive member 14 protrudes from the hollow member 25 upwardly by a first spring force of the first spring S4. Moreover, the second conductive member 15 and the second spring S5 are movably disposed in the first conductive member 14. The second spring S5 is in contact with the first and second conductive members 14 and 15, such that the second conductive member 15 protrudes from the first conductive member 14 downwardly by a second spring force of the second spring S5.

As shown in FIG. 2A, when the first conductive member 14 is not pushed by an external force, the second conductive member 15 and the conductive contact 24 are spaced apart by a distance D for electrical insulation therebetween. In this state, even when the pogo pins 11~13 and the first conductive member 14 simultaneously contact a metal conductor, a short circuit between the conductive structure 21 at the leftmost (ground signal) and the conductive contact 24 at the rightmost (power signal) can be avoided, so as to facilitate safety of usage.

In FIGS. 2A and 2B, the first conductive member 14 of the electrical connecting mechanism P4 has a head portion 141, a hollow rod portion 142, and a rib portion 143 between the head portion 141 and the rod portion 142. The rib portion 143 abuts an inner surface of the hollow member 25, so as to prevent the first conductive member 14 from sliding out of the hollow member 25, as shown in FIG. 2A. In this embodiment, the first spring S4 surrounds the rod portion 142 and abuts the rib portion 143. When the first conductive member 14 is not pushed by an external force, the head portion 141 of the first conductive member 14 protrudes from the hollow member 25, and the second conductive member 15 and the second spring S5 are received in the rod portion 142.

As shown in FIG. 2B, the rod portion 142 of the first conductive member 14 has an opening 1420 formed on an end surface 1421 thereof. Additionally, the second conductive member 15 is movably disposed in the rod portion 142, having a base portion 152 and an extending portion 151 connected to each other. The diameter of the base portion 152 exceeds that of the extending portion 151, and the extending portion 151 protrudes from the end surface 1421 through the opening 1420. The base portion 152 is restricted in the rod portion 142 and abuts an inner surface of the rod portion 142, thereby preventing the second conductive member 15 from sliding out of the first conductive member 14.

Figure 3A:
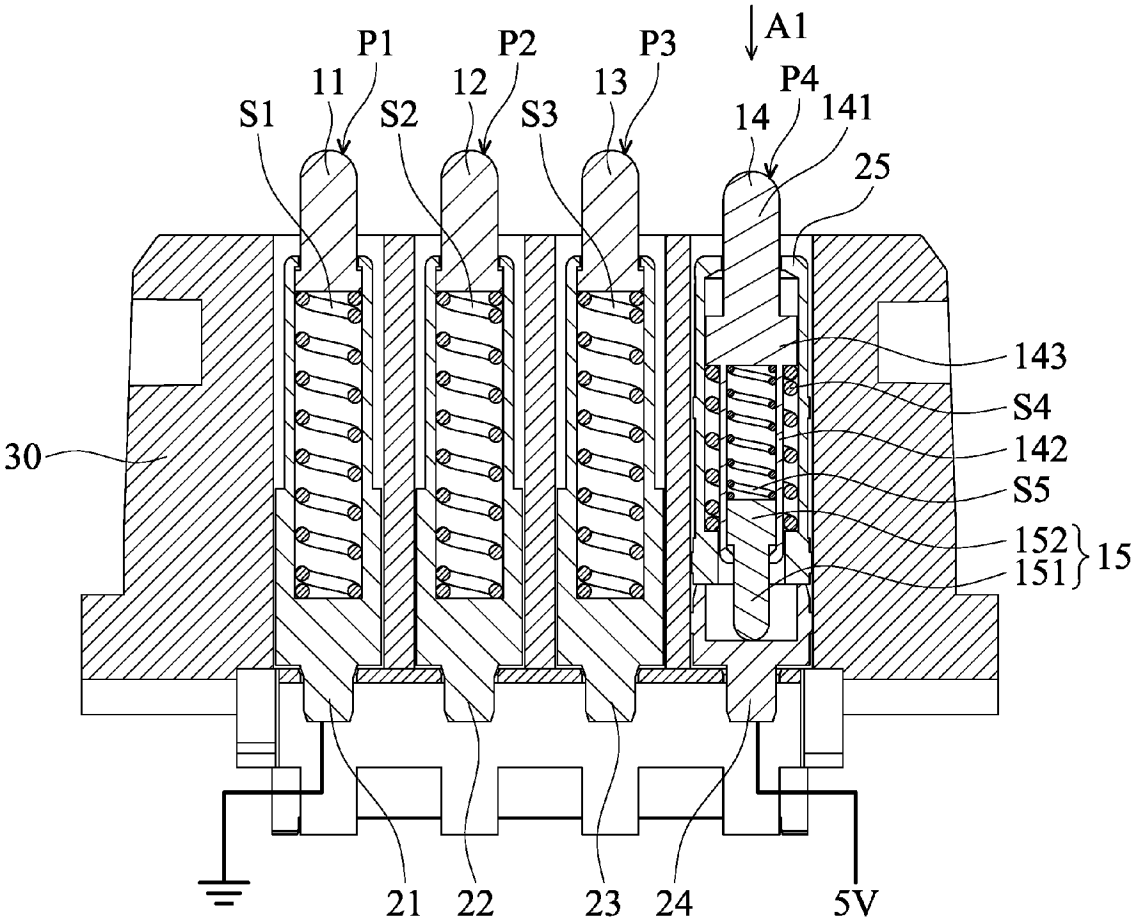
FIG. 3A is a schematic diagram representing the first conductive member in FIG. 2A when pushed by an external force and sliding to a predetermined position.
Figure 3B:
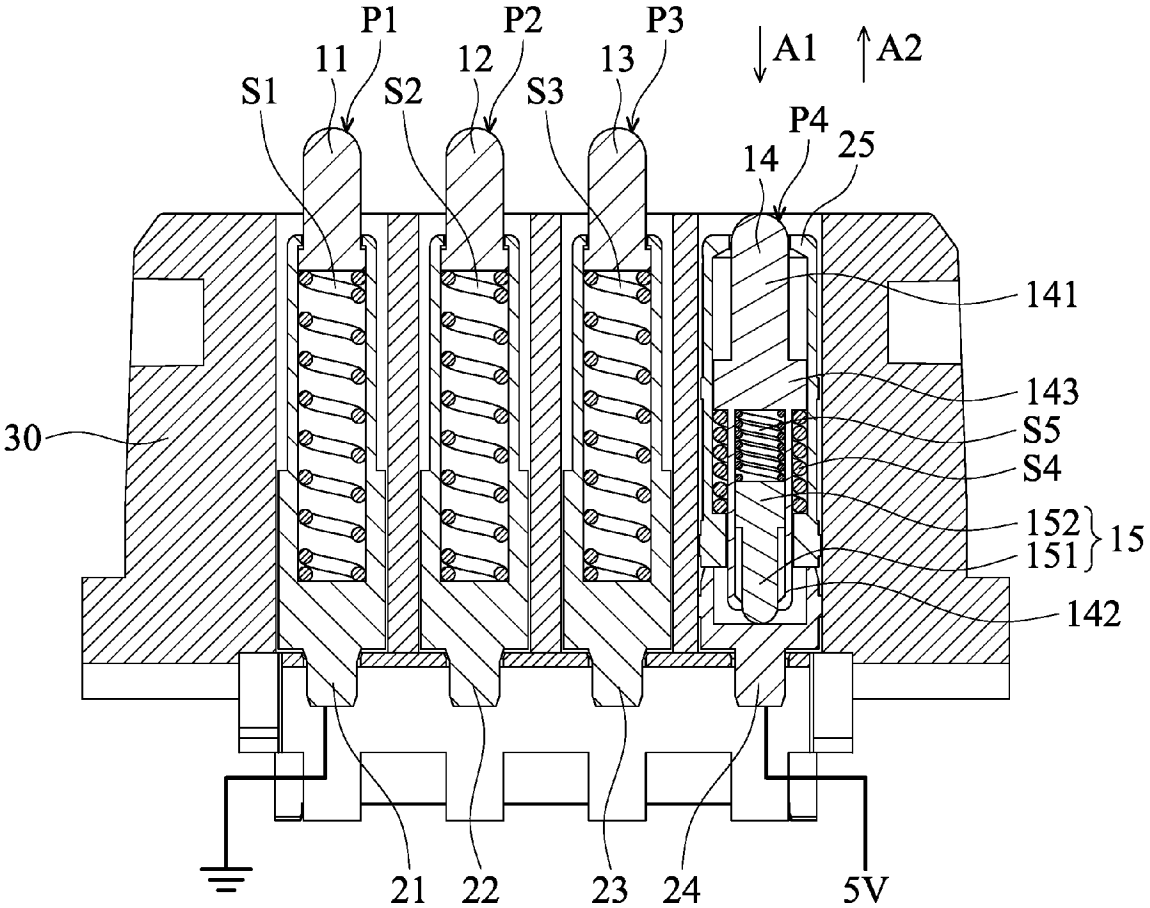
FIG. 3B is a schematic diagram representing the second conductive member in FIG. 3A when retracted into the first conductive member.

Referring to FIG. 3A, when the first conductive member 14 is pushed by an external force and slides in a first direction A1 to a predetermined position with respect to the hollow member 25, the first conductive member 14 is retracted in the housing 30. Meanwhile, the first spring S4 is in a compressed state, and the second conductive member 15 is moved along with the first conductive member 14 in the first direction A1 to contact the conductive contact 24. Thus, the first conductive member 14 and the conductive contact 24 are electrically connected through the second conductive member 15. Referring to FIG. 3B, when the first conductive member 14 is continuously pushed by the external force and further slides in the first direction A1 relative to the hollow member 25 from the predetermined position as shown in FIG. 3A, the second conductive member 15 is stopped by the conductive contact 24 and then retracted into the first conductive member 14 along a second direction A2. In this state, the second spring S5 is compressed, and the second direction A2 is opposite to the first direction A1.

When the external force is released, the compressed first and second springs S4 and S5 can return to the state shown in FIG. 2A by their recovery force, such that the second conductive member 15 is separated from the conductive contact 24, and the short circuit between the conductive structure 21 (ground signal) and the conductive contact 24 (power signal) owing to unintentional touch can be efficiently prevented.

Figure 4B:
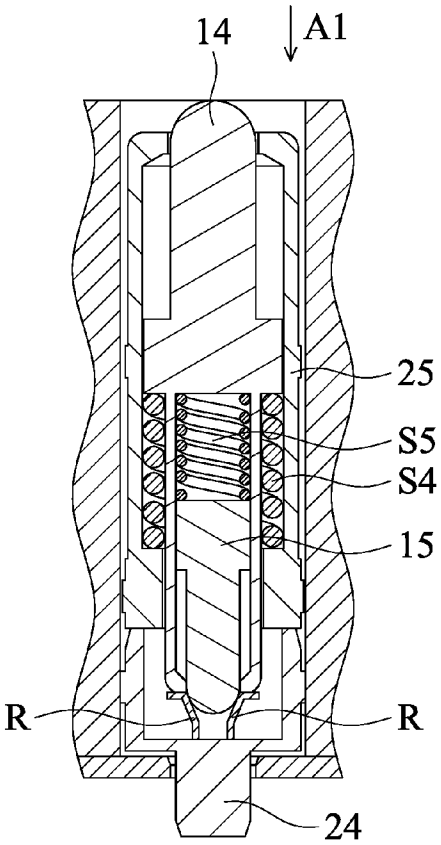
FIGS. 4A and 4B are partial cross-section views of a connector according to another embodiment of the invention.
Figure 4A:
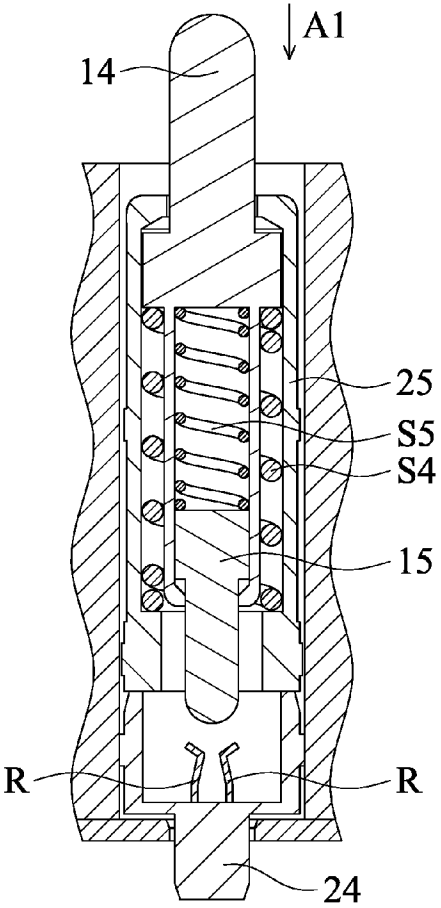

Referring to FIGS. 4A and 4B, the conductive contact 24 according to another embodiment of the invention forms an upwardly extended resilient structure R, such as a metal sheet. When the first conductive member 14 is pushed by an external force and slides in the first direction A1 relative to the hollow member 25, as shown in FIG. 4B, the second conductive member 15 is moved along with the first conductive member 14 to contact the resilient structure R, such that electrical connection between the first conductive member 14 and the conductive contact 24 is achieved. In this embodiment, as the resilient structure R can deform to contact a side surface of the second conductive member 15, it can be used as a buffer between the electrical connecting mechanism P4 and the conductive contact 24, to prevent damages of the connector when an external impact occurs on the electrical connecting mechanism P4.

It is noted that the connector throughout the embodiments of the disclosure has at least an electrical connecting mechanism P4, and it may further have one or several pogo pin units, such as the pogo pin units P1~P3, wherein the conductive contact 24 corresponding to the electrical connecting mechanism P4 may connect to a power signal or a ground signal. In some embodiments, the first and second conductive members 14 and 15 may comprise metal, the hollow member 25 may comprise insulating material such as plastic, and the hollow member 25 and the housing 30 may be integrally formed in one piece.

In summary, the invention provides a pogo pin connector. When a first conductive member in an electrical connecting mechanism is not pushed by an external force, the first conductive member and a conductive contact in the connector are spaced apart by a distance for electrical insulation therebetween. Therefore, even when the first conductive member and the pogo pins simultaneously contact a metal conductor, a short circuit between ground and power signals can be avoided, so as to facilitate safety of usage.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

Use of ordinal terms such as "first", "second", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A connector, comprising:

a housing;

a conductive contact, disposed in the housing;

a hollow structure, disposed in the housing; and an electrical connecting mechanism, movably disposed in the hollow structure, comprising a first conductive member, a first spring, a second conductive member, and a second spring; wherein the first spring connects the first conductive member with the hollow structure and provides a first spring force such that the first conductive member protrudes from the hollow structure; the second conductive member and the second spring are movably disposed in the first conductive member, and the second spring connects to the first and second conductive members and provides a second spring force such that the second conductive member protrudes from the first conductive member;

wherein the second conductive member and the conductive contact are spaced apart by a distance, and when the first conductive member is pushed by an external force and slides in a first direction to a predetermined position with respect to the hollow structure, the first spring is compressed, and the second conductive member moves in the first direction and contacts the conductive contact.

2. The connector as claimed in claim 1, wherein when the first conductive member is further pushed by the external force and slides from the predetermined position in the first direction with respect to the hollow member, the second conductive member slides with respect to the first conductive member in a second direction opposite to the first direction, and the second spring is compressed.

3. The connector as claimed in claim 1, wherein the first conductive member has a head portion, a hollow rod portion, and a rib portion; the head portion protrudes from the hollow member, the second conductive member and the second spring are disposed in the rod portion, and the rib portion is disposed between the head and rod portions and abuts the hollow member, so as to prevent the first conductive member from sliding out of the hollow member.

4. The connector as claimed in claim 3, wherein the first spring surrounds the rod portion and abuts the rib portion.

5. The connector as claimed in claim 3, wherein the rod portion has an end surface and an opening formed on the end surface, and the second conductive member has a base portion and an extending portion connected to each other, wherein the extending portion protrudes from the end surface through the opening, and the base portion is disposed in the rod portion and abuts an inner surface of the rod portion, so as to prevent the second conductive member from sliding out of the first conductive member.

6. The connector as claimed in claim 1, wherein the conductive contact is connected to a ground signal or a power signal.

7. The connector as claimed in claim 1, wherein the connector further comprises at least a pogo pin unit and at least a conductive structure, the conductive structure is disposed in the housing, and the pogo pin unit is electrically connected to the conductive structure.

8. The connector as claimed in claim 7, wherein the hollow structure comprises insulating material.

9. The connector as claimed in claim 1, wherein the conductive contact has a resilient structure, and when the first conductive member is pushed by an external force and slides in the first direction relative to the hollow member, the resilient structure deforms and contacts a side surface of the second conductive member.

10. The connector as claimed in claim 9, wherein the resilient structure comprises a metal sheet.

* * * * *